US005165042A

United States Patent [19]

Klinger

[11] Patent Number: 5,165,042

[45] Date of Patent: Nov. 17, 1992

[54] COVER PLATE APPARATUS FOR ELECTRICAL OUTLET

[76] Inventor: Harry E. Klinger, P.O. Box 1563, North Eastham, Mass. 02651

[21] Appl. No.: 570,326

[22] Filed: Aug. 21, 1990

[51] Int. Cl.[5] ..... H01R 13/447

[52] U.S. Cl. ..... 174/67; 439/136

[58] Field of Search ..... 174/67; 220/242; 439/136

[56] References Cited

U.S. PATENT DOCUMENTS

| | | | |
|---|---|---|---|
| 2,916,733 | 12/1959 | Hirsch | 174/67 X |
| 3,865,456 | 2/1975 | Dola | 339/40 |
| 4,605,270 | 8/1986 | Asizadeh | 339/40 |
| 4,607,136 | 8/1986 | Thomas | 174/67 |
| 4,640,564 | 2/1987 | Hill | 339/40 |
| 4,810,833 | 3/1989 | Meyers | 174/67 |
| 4,857,004 | 8/1989 | Poirier | 174/67 |

*Primary Examiner*—Leo P. Picard
*Assistant Examiner*—David A. Tone
*Attorney, Agent, or Firm*—Thomas A. Kahrl

[57] ABSTRACT

A cover plate apparatus for electrical outlets which comprises a bracket for mounting a plurality of female electrical receptacles including a first and second electrical receptacle connected to the electrical conduit, a base plate attached to the mounting bracket having longitudinal tongue members and a decorative face plate having an outer and inner surface and a central channel for receiving the raised rib provided in the base plate for slideable movement between a closed position wherein the receptacles are completely closed to an open position wherein the electrical receptacles are accessible to receive a male electrical plug having prongs for making an electrical connection.

6 Claims, 2 Drawing Sheets

COVER PLATE APPARATUS FOR ELECTRICAL OUTLET

BACKGROUND OF THE INVENTION

Cover plates for electrical outlets are known which deny access to the outlets. In particular with respect to safety of small children, providing covers for electrical outlets has been primarily directed to providing a safety shield for exposed electrical outlets to prevent access to such outlets when an electrical plug is not in service and installed therein. Typically such related art covers for electrical outlets are described in U.S. Pat. Nos. 3,865,456 issued Feb. 11, 1975, 4,605,270 issued Aug. 12, 1986, 4,607,136 issued Aug. 19, 1986 and 4,640,564 issued Feb. 3, 1987.

It is also recognized that electrical outlets are utilitarian in purpose and as such detract from the appearance of the wall or surface on which they are installed. While prior electrical outlet covers have been effective in providing safety shields, they have an appearance of an electrical receptacle which is lacking in esthetically pleasing appearance.

It is therefore desirable to provide a cover which both covers the outlet for safety reasons and provides a masking surface to cover the electrical outlet in a simple, inexpensive, decorative and esthetically pleasing manner.

SUMMARY OF THE INVENTION

This invention is directed to an improved cover plate apparatus for electrical outlets. In particular the invention concerns a cover plate apparatus employing a decorative face plate means slideably mounted on an electrical receptacle for movement between a open position and a covered position wherein the decorative face plate alternately provides an esthetically pleasing appearance and safety factor by enclosing the electrical outlet when not in service.

Briefly the invention comprises an improved cover plate apparatus for an electrical outlet which includes an electrical conduit means having a one and other end, the other end connected to an electrical power source, a plurality of female electrical receptacles including a first and second receptacle connected to the one end of the conduit means, a bracket having a front and a back for mounting the female receptacles in a fixed position on a wall, a base plate mounted on the front of the bracket and a decorative face plate slideably mounted on the base plate.

The bracket is of rectangular construction having four walls defining an interior space adapted to receive a plurality of electrical receptacles comprising a first and second receptacle, with provision for mounting the receptacle on the base of the bracket. Typically the bracket is installed in a cavity provided in a wall of a room of a building with convenient access to electrical appliances, the wall typically having a decorative exterior finish of wallpaper or paint. Such installation to be convenient for access by a user are typically located above the floor level and very often in a conspicuous location.

As normally installed, the bracket is provided with a conventional cover plate having a pair of apertures for accessing the receptacles which does not match its surroundings and therefore, together with the exposed receptacles contained therein, is conspicuous and not harmonized with surrounding wallpaper or paint. In place of the conventional cover plate, a base plate is provided for mounting on the front of the bracket over the first and second receptacles having a top and bottom surface and a plurality of apertures superimposed over the receptacles for providing access thereto for the prongs of an electrical male plug connected by conduit to an appliance to be plugged into the receptacle by a user.

The base plate includes a rib provided on the top surface having a raised surface extending longitudinally along the entire central access of the base plate having a plurality of grooves spaced apart on opposite sides of the rib for slideable mounting of a face plate for movement between a closed position and an open position. The base plate also includes a pair of rails spaced apart positioned adjacent to and extending outwardly from the channel for providing a support for a face plate during movement between the closed position and the open position. A post extending outwardly from the base plate in perpendicular relationship with the surface of the rib for cooperative engagement with a spring clip mounted on the base plate.

The decorative face plate having a one and other end, and an outer and inner surface is of greater size than the base plate for being superimposed over the base plate and for covering the within contained electrical receptacles. The outer surface of the face plate having a unitary area greater than the base plate and having tongue means provided on opposite horizontally extending sides of the base plate for slideably mounting the face plate. The tongue means cooperatively fit in the grooves of the base plate for movement of the face plate between an open and a closed position. A longitudinal slot having a one end and other end is provided in the inner channel having a spring clip at the one end for cooperatively receiving the post extending inwardly from the base plate.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DESCRIPTION OF THE EMBODIMENTS

Figure 1:
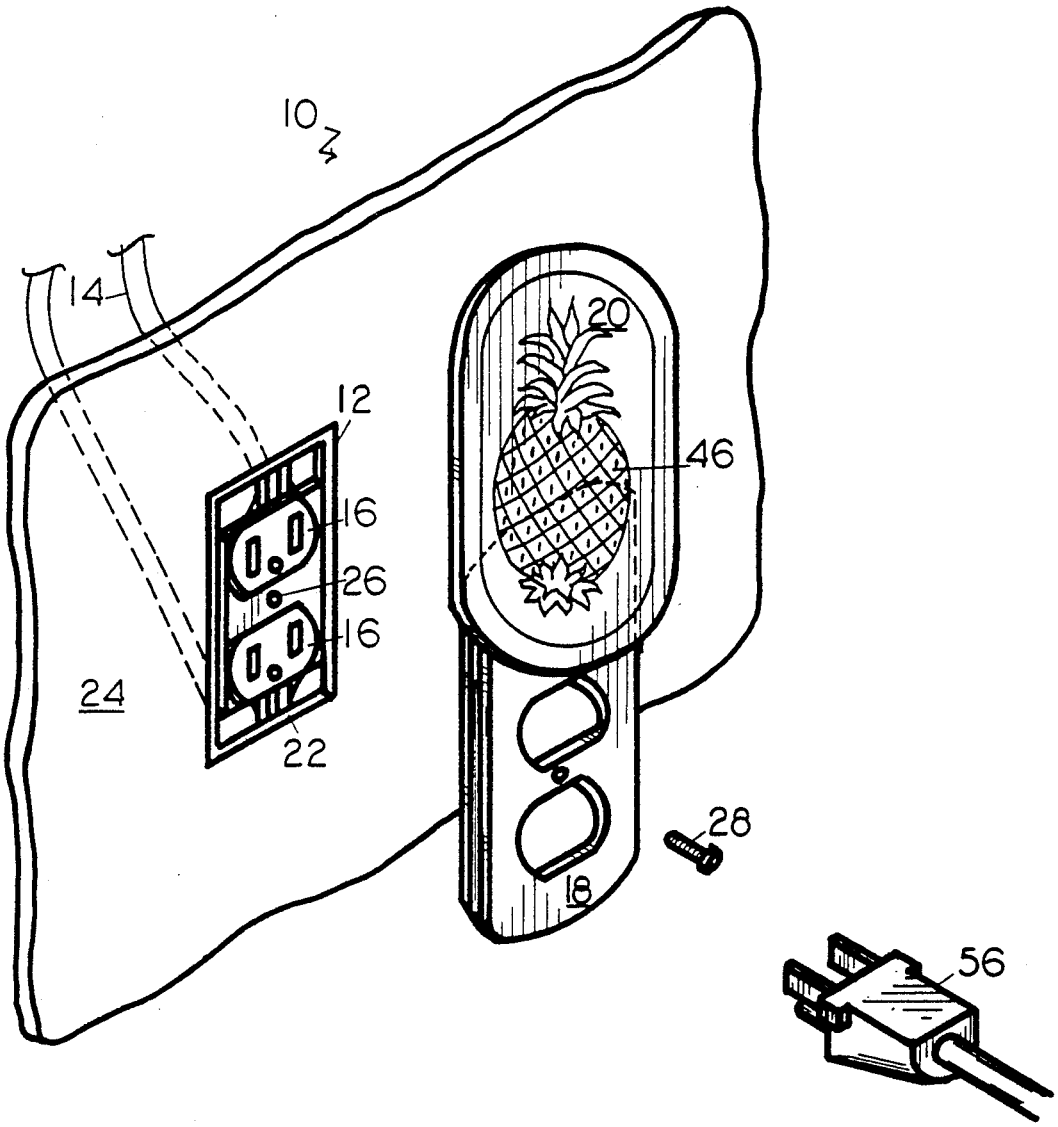
FIG. 1 is a fragmentary exploded view of the cover plate apparatus of the invention exploded from a wall mounted bracket.

With reference to the drawings, there is shown and illustrated a cover plate apparatus 10 of the invention which includes a rectangular bracket 12 connected by electrical conduit means 14 to a power source not shown, a plurality of female electrical receptacles 16 connected to the electrical conduit means 14 and mounted on the bracket 12, a base plate 18 mounted on the bracket 12 over the receptacle 16 and a decorative face plate 20 slideably mounted on the base plate 18. The bracket 12 is of rectangular construction and is installed in a cavity 22 provided in a generally flat wall surface 24. The electrical receptacles 16 typically two in number, are mounted in spaced apart parallel relationship. A tapped hole 26 is centrally positioned in the bracket 12 adapted to receive a mounting screw 28.

Figure 3:
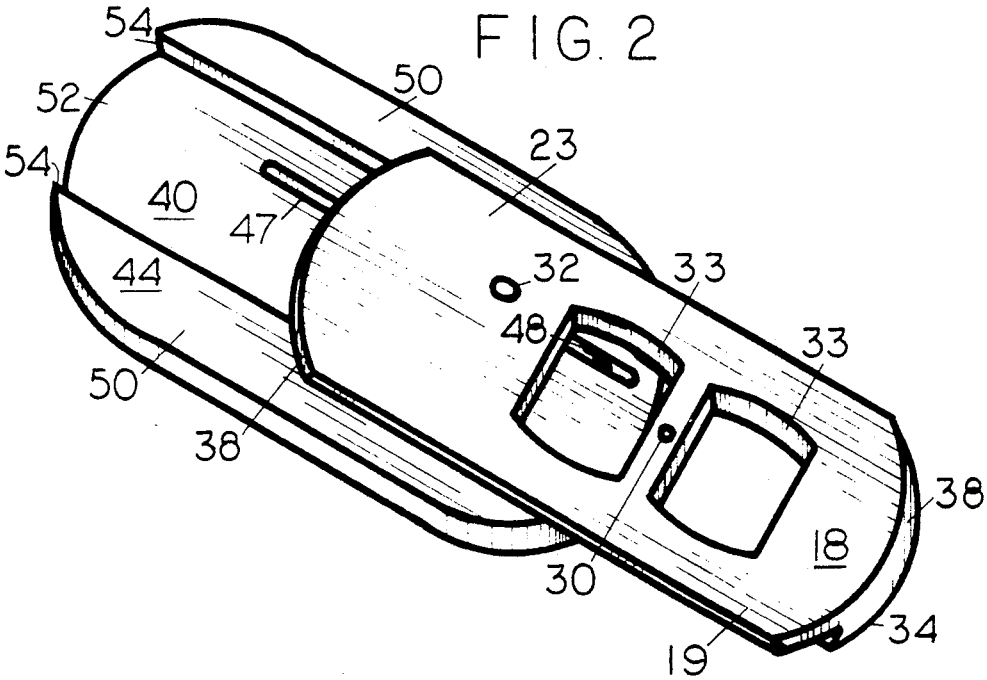
FIG. 3 is an illustrated perspective view from below of the cover plate apparatus shown in FIG. 1 with the cover plate in the open position.
Figure 4:
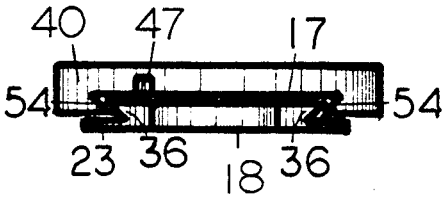
FIG. 4 is a sectional view of the cover plate apparatus shown in FIG. 2 along the line of the base plate showing the interaction of the tongues along the grooves of the face plate.

As shown in FIGS. 3 and 4, the base plate 18 typically constructed of wood or plastic, having an upper surface 17 and a bottom surface 19 and a short end 12 and an elongated end 23, is mounted on the bracket 12 by a screw 28 threaded through opening 30 provided in the mid-section of the base plate 18 and thereafter being threaded into the tapped hole 26 in the center of bracket 12. A post 32 is provided in the elongated end of the base plate 18 extending perpendicularly upwardly a short distance from the upper surface 17. A plurality of apertures 33, spaced apart a distance equal to that of the spacing of the electrical receptacles, aligned in parallel relationship, are provided in the base plate 18. A central raised rib 34 is provided extending along the longitudinal axis of the base plate 18 having a flat top surface and a parallel flat bottom surface and a pair of spaced apart longitudinally extending tongue elements 36 in spaced apart parallel alignment. The base typically has generally curved ends 38.

The decorative cover plate 40 as shown in FIG. 1 typically constructed of wood or plastic has an outer surface 42 and an inner surface 44, the outer surface having a design element 46 embossed thereon. The cover plate 40 has a short end and an elongated end, and comprises a central channel extending longitudinally having a pair of spaced apart groove elements together with a central longitudinal slot 47 having a one end and an other end and including a spring clip 48 for receiving the post 32.

Figure 2:
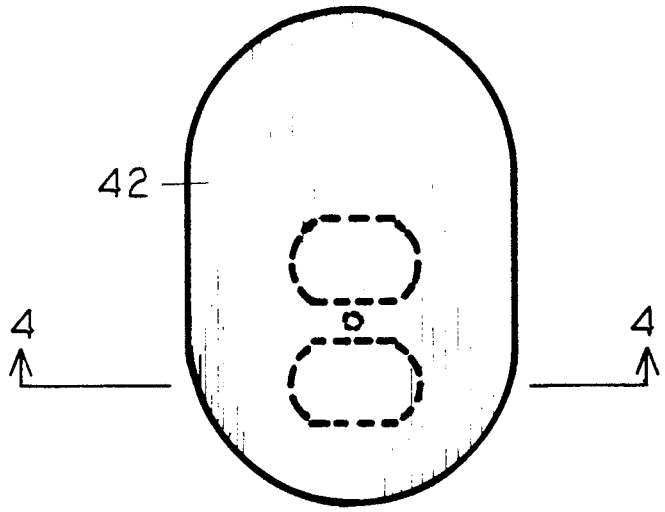
FIG. 2 is a front view of the face plate apparatus of the cover plate illustrated in FIG. 1 shown in the covered position.

A pair of spaced apart rails 50 extending longitudinally and positioned adjacent to and extending outwardly from the central channel 52 each having a dove tailed groove 54 for receiving the dove tailed tongue elements 36 of the base plate 18. The face plate 20 is thereby slideably mounted over the base plate 18 for movement between a closed position shown in FIG. 2 wherein the receptacles 33 are covered, to the open position shown in FIG. 1 wherein the receptacles 33 are exposed to receive a male plug 56 attached to an appliance not shown.

What is claimed is:

1. A cover plate apparatus for covering an electrical outlet which includes;

a first receptacle and a second receptacle mounted on a mounting bracket adapted for mounting the electrical receptacles on a wall;

said cover plate apparatus comprising;

a base plate having a one and other end for mounting on the mounting bracket over the receptacles with a plurality of apertures provided adjacent the receptacles, having a top and bottom surface and comprising a central rib having a pair of spaced apart dovetailed tongues and a post extending perpendicularly to the top surface;

a face plate having a one and other end and an inner surface and outer surface having a decorative finish and a central longitudinally extending channel provided on the inner surface having a pair of spaced apart dovetailed grooves for cooperatively engaging the dovetailed tongues of the base plate, and a longitudinal slot having a one and an other end having a spring clip on the one end for engaging the post extending perpendicularly outwardly from the base plate for permitting slideable movement between a closed position, wherein the receptacles and base plate are completely covered by the face plate and an open position wherein the other end of the face plate extends outwardly from the other end of the base plate to expose the two receptacles and to permit access thereto by a male electrical plug.

2. The cover plate apparatus of claim 1 wherein the base plate is mountable on the front of the bracket over the first and second electrical receptacles, said plurality of apertures for providing access to the first and second electrical receptacles for the prongs of an electrical male plug.

3. The cover plate apparatus of claim 1 wherein the rib is provided on the top surface of the base plate, extending longitudinally along the entire central axis of the base plate having a plurality of grooves spaced apart on opposite sides of the rib for slideable mounting of said face plate for movement between a closed position and an open position.

4. The cover plate apparatus of claim 1 wherein the face plate includes a pair of rail means spaced apart positioned adjacent to and extending outwardly from the channel for providing a support for the face plate during movement between the closed position and the open position.

5. The cover plate apparatus of claim 1 wherein said face plate is of greater size than the base plate for superimposing over the base plate and for covering the electrical receptacles, said apparatus further comprising;

i) the outer surface having a decoration and having a unitary area greater than the base plate, the inner surface having tongue means provided on opposite sides thereof for slideably mounting the face plate on the base plate with the tongues cooperatively fitting in the grooves for movement of the face plate between an open and a closed position;

ii) said inner surface channel provided on the inner surface of the face plate extending longitudinally along the entire central axis thereof.

6. In an electrical outlet which comprises;

a) an electrical conduit having a first and other end for connecting to a source of electrical power;

b) female receptacle means comprising a first and second electrical receptacle connected to the electrical conduit and for receiving prongs of an electrical male plug;

c) a mounting bracket installed in a recess provided in the wall for mounting the female receptacle means having a one end and an other end;

d) a tapped hole positioned in the mounting bracket for receiving a mounting screw, the improvement which comprises;

e) a base plate mounted on the mounting bracket over the first and second electrical receptacles having a plurality of apertures for providing access to the first and second electrical receptacles by the prongs of an electrical male plug;

f) a raised rib provided on the top surface of the base plate extending longitudinally along the entire central axis of the base plate having a plurality of dovetailed longitudinal grooves spaced apart on opposite sides of the raised rib comprising a first and second groove extending along the outer edges of the raised rib for slideable mounting of a face plate for movement between a closed position and an open position;

g) a face plate having a one and other end and an outer and inner surface and being of greater size than the base plate for superimposing over the base plate and for covering the within contained electrical receptacles comprising;

i) the outer surface has a unitary area greater than the area of the base plate;

ii) dovetailed tongue means provided on opposite horizontal extending sides of the face plate for slideably mounting the face plate on the base plate with the dovetailed tongue means cooperatively fitting in the dovetailed grooves for movement of the face plate between an open and a closed position;

iii) a channel provided on the inner surface of the face plate extending longitudinally along the entire central axis thereof.

* * * * *